US012320207B2

(12) United States Patent
Bouaziz et al.

(10) Patent No.: US 12,320,207 B2
(45) Date of Patent: Jun. 3, 2025

(54) VIBRATION MITIGATION TOOL

(71) Applicant: NATIONAL OILWELL VARCO, L.P., Houston, TX (US)

(72) Inventors: Souhail Bouaziz, Pearland, TX (US); Jonathan Getz, Spring, TX (US); Chigozie Emuchay, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/164,981

(22) Filed: Feb. 6, 2023

(65) Prior Publication Data

US 2024/0263527 A1 Aug. 8, 2024

(51) Int. Cl.
*E21B 17/07* (2006.01)

(52) U.S. Cl.
CPC ..... *E21B 17/07* (2013.01); *E21B 17/073* (2013.01)

(58) Field of Classification Search
CPC ..... E21B 17/07; E21B 17/073
See application file for complete search history.

(56) References Cited

U.S. PATENT DOCUMENTS

| | | | | |
|---|---|---|---|---|
| 4,254,837 | A * | 3/1981 | Jones | E21B 17/07 175/321 |
| 10,533,376 | B2 | 1/2020 | Reimers | |
| 2011/0198126 | A1* | 8/2011 | Swietlik | E21B 17/07 175/320 |
| 2014/0224537 | A1 | 8/2014 | Wassell et al. | |
| 2015/0376959 | A1 | 12/2015 | Dinica et al. | |
| 2016/0230479 | A1* | 8/2016 | Khaparde | E21B 17/07 |
| 2017/0328142 | A1* | 11/2017 | Pratt | E21B 47/18 |
| 2017/0342781 | A1* | 11/2017 | Reimers | E21B 17/073 |
| 2023/0124872 | A1* | 4/2023 | von Gynz-Rekowski | E21B 17/073 175/61 |

FOREIGN PATENT DOCUMENTS

| | | |
|---|---|---|
| CN | 114517646 | 5/2022 |
| WO | 2022170414 | 8/2022 |
| WO | 2024167693 | 8/2024 |

OTHER PUBLICATIONS

"International Application Serial No. PCT US2024 013076, Invitation to Pay Additional Fees mailed Apr. 30, 2024", 5 pgs.
"International Application Serial No. PCT US2024 013076, International Search Report mailed Jun. 26, 2024", 6 pgs.
"International Application Serial No. PCT US2024 013076, Written Opinion mailed Jun. 26, 2024", 10 pgs.

* cited by examiner

*Primary Examiner* — Tara Schimpf
*Assistant Examiner* — Jennifer A Railey
(74) *Attorney, Agent, or Firm* — Schwegman Lundberg & Woessner, P.A.

(57) ABSTRACT

A vibration mitigation tool may include a mandrel portion, a sleeve portion arranged about the mandrel portion and configured to move longitudinally and rotationally relative to the mandrel portion. The tool may also include a spring stack configured to control compression on the vibration mitigation tool through compression of the spring stack and to control tension on the vibration mitigation tool through compression of the spring stack. A helical engagement between the mandrel portion and the sleeve portion may also be provided.

7 Claims, 7 Drawing Sheets

VIBRATION MITIGATION TOOL

TECHNOLOGICAL FIELD

The present application relates to drill string elements, components, tools, or other equipment arranged along the length of the drill string and/or within the bottom whole assembly of well drilling equipment. Still more particularly, the present application relates to vibration absorbing elements, components, tools, or other equipment. Still more particularly, the present application relates to a vibration mitigation tool particularly adapted to absorb axial, lateral, and/or torsional forces or vibrations from stick-slip, drill bit over-engagement, inconsistent weight transfer, and the like.

BACKGROUND

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Drill strings include a large number of drill pipes connected end-to-end to form a drill string. At or near the distal or bottom end of the drill string, the drill string may be more robust and may be referred to as drill collar. This distal or bottom end may also include a bottom hole assembly. The bottom hole assembly or even portions of the drill string above the bottom hole assembly may include a variety of downhole tools including, for example, a drill bit, mud motors, rotary steering systems (RSS), measurement while drilling (MWD) systems and the like.

These tools, the overall drill string, and the bottom hole assembly may be subject to varying levels of shock and vibration generated by forces at the drill bit, mud motors, power section, stabilization, other bottom hole assembly components, well geometry, etc. Shock and vibration can negatively affect drilling efficiency. For example, the rate of penetration may be slower. As another example, the signals from measurements (e.g., MWD) may have bad quality. Still further, fatigue or wear on the downhole tools in the form of wear of the threaded connections, wear or damage of internal devices, poor directional control, and/or bit damage may also occur.

SUMMARY

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more examples, a vibration mitigation tool may include a mandrel portion and a sleeve portion arranged about the mandrel portion and configured to move longitudinally and rotationally relative to the mandrel portion. The tool may also include a spring stack configured to control compression on the vibration mitigation tool through compression of the spring stack and to control tension on the vibration mitigation tool through compression of the spring stack. The tool may also include a helical engagement between the mandrel portion and the sleeve portion.

In one or more examples, a vibration mitigation tool may include a mandrel portion and a sleeve portion arranged about the mandrel portion and configured to move longitudinally and rotationally relative to the mandrel portion. The mandrel portion and the sleeve portion, together, may form a lubrication chamber including a first or upper portion configured for lubricating a helical engagement, a second or central portion for lubricating a biasing mechanism, and a third or lower portion for interfacing with a pressure equalization chamber.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present application, in one or more embodiments, relates to a downhole vibration mitigation tool for a drill string in a wellbore. In particular, the tool comprises first and second sections that are longitudinally and rotationally moveable relative to one another where the relative motion is controlled by a spring stack and a helical engagement. The spring stack functions to absorb both tensile and compressive forces and the helical engagement ties the contraction and elongation of the tool to particular amounts of relative rotation. The tool absorbs vibrations from varying levels of shock and vibration generated by forces at the drill bit, mud motors, and/or other bottom hole assembly components, well geometry and the like. Thus, the tool helps to protect various aspects of the bottom hole assembly and drill string from wear and/or damage and provides for a more efficient well drilling process.

Figure 1:
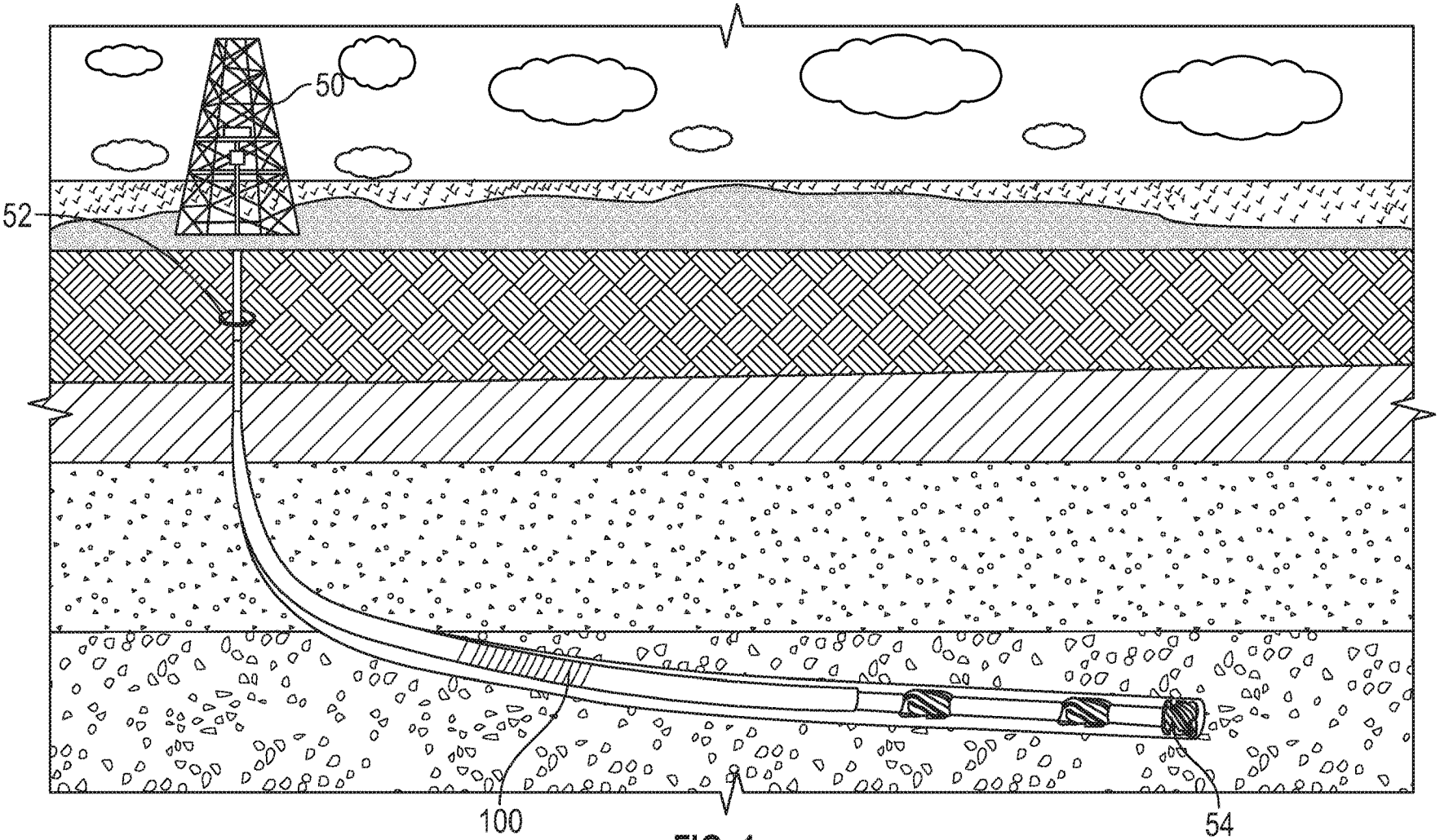
FIG. 1 is a cross-sectional view of a drill rig drilling a wellbore where the drill string includes a vibration mitigation tool, according to one or more examples.

FIG. 1 is a cross-section view of a drilling rig 50 drilling a well and having a drill string 52 with several tools arranged in the string, according to one or more embodiments. As shown, the drilling system may include a drill rig 50 having a mast, a drill floor, and a variety of pipe handling equipment adapted to connect drill pipe, stands, or tubulars end-to-end to feed a drill string into a wellbore. The equipment may include, for example, a top drive, an iron roughneck, one or more pipe elevators, drill floor slips, a racking board, and other equipment used to manage drilling and tripping operations. Drill fluid systems may also be provided for pumping drilling fluid into and through the drill string to operate a drill bit arranged at the tip of the drill string.

As shown, the drill string 52 may include a series of drill pipes connected end-to-end extending downward from the drill rig 50 into a wellbore in the ground. The drill string 52 may include a bottom hole assembly (BHA) 54 arranged at the tip of the string that includes drill bit, a steering system, one more measuring devices and the like. Upward from the drill bit may be a vibration mitigation tool 100 adapted to absorb axial, lateral, and/or torsional shocks and/or vibrations. While a particular arrangement of tools has been discussed, other arrangements may be provided where, for example, the particular order of tools behind the BHA is changed or modified.

Figure 2:
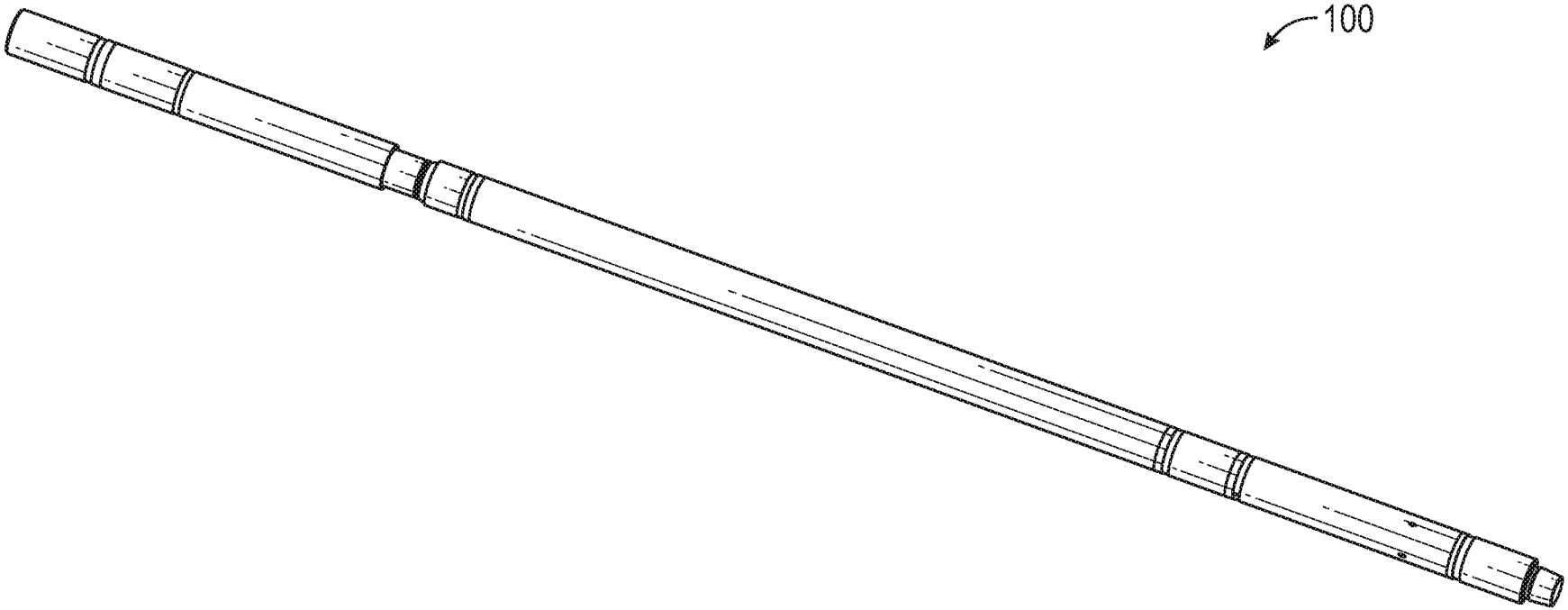
FIG. 2 is a perspective view of the vibration mitigation tool of FIG. 1 in isolation from a drill string, according to one or more examples.

Turning now to FIG. 2, a vibration mitigation tool 100 is shown in isolation from the drill string 52. As mentioned, the vibration mitigation tool 100 may be configured for absorbing axial, lateral, and/or torsional shocks and/or vibrations in the drill string 52. For example, and as shown in the cross-sectional and exploded view of FIG. 3, the tool 100 may include a central elongate mandrel portion 102 and a sleeve portion 104 that articulates longitudinally and rotationally along and around the mandrel portion 102. A helical engagement 108 may be provided between the central elongate mandrel portion 102 and the sleeve portion 104 to guide the relative rotational motion and tie that rotation motion to the longitudinal motion. A biasing mechanism 106, such as a spring stack, may be provided help to control the relative longitudinal motion of the mandrel portion 102 and the sleeve portion 104.

Figure 4A:
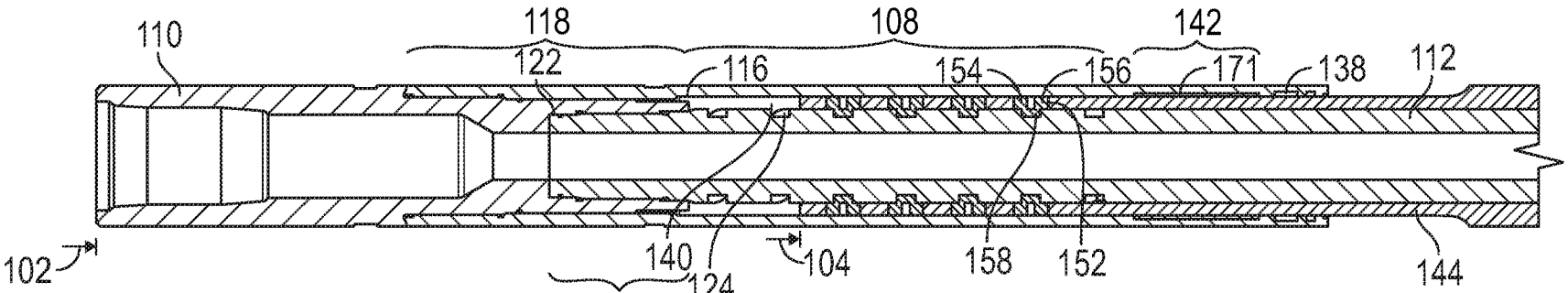
FIG. 4A is close-up cross-sectional view of a proximal portion of the vibration mitigation tool of FIGS. 1-3.

The mandrel portion 102 or, more specifically, the central elongate mandrel portion may extend through a majority of the length of the tool 100 and may be configured for providing a stem upon and about which the biasing mechanism may be mounted and about which the sleeve portion 104 may be mounted. The sleeve portion 104 may articulate longitudinally and rotationally along and about the mandrel portion 102. As shown in FIG. 4A, the mandrel portion 102 may include a proximal box end 110, a lead screw 112, an elongate stem or spring tube 114, and an enclosure 116.

The proximal box end 110 may be arranged at the proximal end of the mandrel portion 102 and may be configured to receive a pin end of an upstream or up-string component along the drill string 52. The proximal box end 110 may be a generally tubular element with an outer cylindrical wall and an inner bore extending therethrough. The inner bore may include a various portions with various diameters adapted for engaging with up-string components or systems and may include internal threading for engaging those components. At a distal portion of the proximal box end 110, a length 118 of the proximal box end may have a smaller diameter to provide an outer recess for receiving the enclosure 116. Also at a distal portion of the proximal box end 110, the bore may have a larger diameter to provide an annular pocket 120 to receive a pin end of the lead screw 112. A threaded surface may be provided along the inner surface of the bore for engaging the pin end of the lead screw 112. In addition, one or more annular grooves 122 may be provided on the inner surface of the bore within the annular pocket 120 to hold and/or receive O-rings or other sealing elements to provide a seal between the proximal box end 110 and the lead screw 112. Alternatively, one or more annular grooves 122 for seals may be provided on an outside surface of the pin end of the lead screw 122. In one or more examples, grooves 122 may be provided on the inner surface of the bore and on the pin end of the lead screw.

The lead screw 112 may be secured to the distal end of the proximal box end 110 and may extend distally therefrom. The lead screw 112 may be configured to engage a distal end of the sleeve portion 104 in a manner that causes relative rotation of the mandrel portion 102 and the sleeve portion 104 when the two parts move longitudinally relative to one another or vice versa (e.g., cause longitudinal motion when the two parts rotate relative to one another). The lead screw 112 may be a generally tubular element with a cylindrical outer surface and a bore extending therethrough. At a distal end, the lead screw 112 may have a pin end sized and adapted for insertion into the annular pocket 120 of the proximal box end 110. Like the annular pocket 120, the outside surface of the pin end may include a threaded surface to engage the threads on an inner surface of the annular pocket 120 to secure the lead screw to the proximal box end 110. As mentioned, annular grooves for sealing may be provided on an outside surface of the pin end, on an inside surface of the annular pocket, or on both. For purposes of controlling the relative longitudinal and rotational motion of the mandrel portion 102 and the sleeve portion 104, the lead screw 112 may include a helical groove 124 extending along the cylindrical outer surface. As shown, multiple interlaced helical grooves may be provided. The helical groove 124 may extend from a location near the pin end distally toward a proximal end of the lead screw 112. The groove 124 may extend along all or a portion of the length of the lead screw 112. In one or more examples, the cross-sectional profile of the groove 124 may be generally square or rectangular or a trapezoidal profile or an inverted trapezoidal profile may be provided. Still other cross-sectional profiles may include rounded or U-shaped grooves, triangular or V-shaped grooves, or other geometrical shapes. The distal end of the lead screw 112 may include a slightly enlarged box end 126 having a diameter larger than the rest of the lead screw, which may form a shoulder 128. The box end 126 of the lead screw 112 may include an annular pocket for receiving the proximal end of the elongate stem or spring tube 114. The details of the engagement of the distal end of the lead screw 112 and the proximal end of the elongate stem or spring tube 114 may be the same or similar to the engagement of the proximal box end 110 and the lead screw 112. That is, the engagement may be a threaded engagement with one or more grooves for sealing elements to be placed therein. As also shown near the middle of FIG. 4B, the distal surface of the box end 126 may include an annular notch 130 for seating of a rib of a bearing sleeve 170 in the sleeve portion 104 discussed in more detail below. The seating of the rib in the annular notch 130 may arrest proximal motion of the bearing sleeve 170 which may help to protect a portion of the biasing mechanism against being overly compressed.

Figure 3:
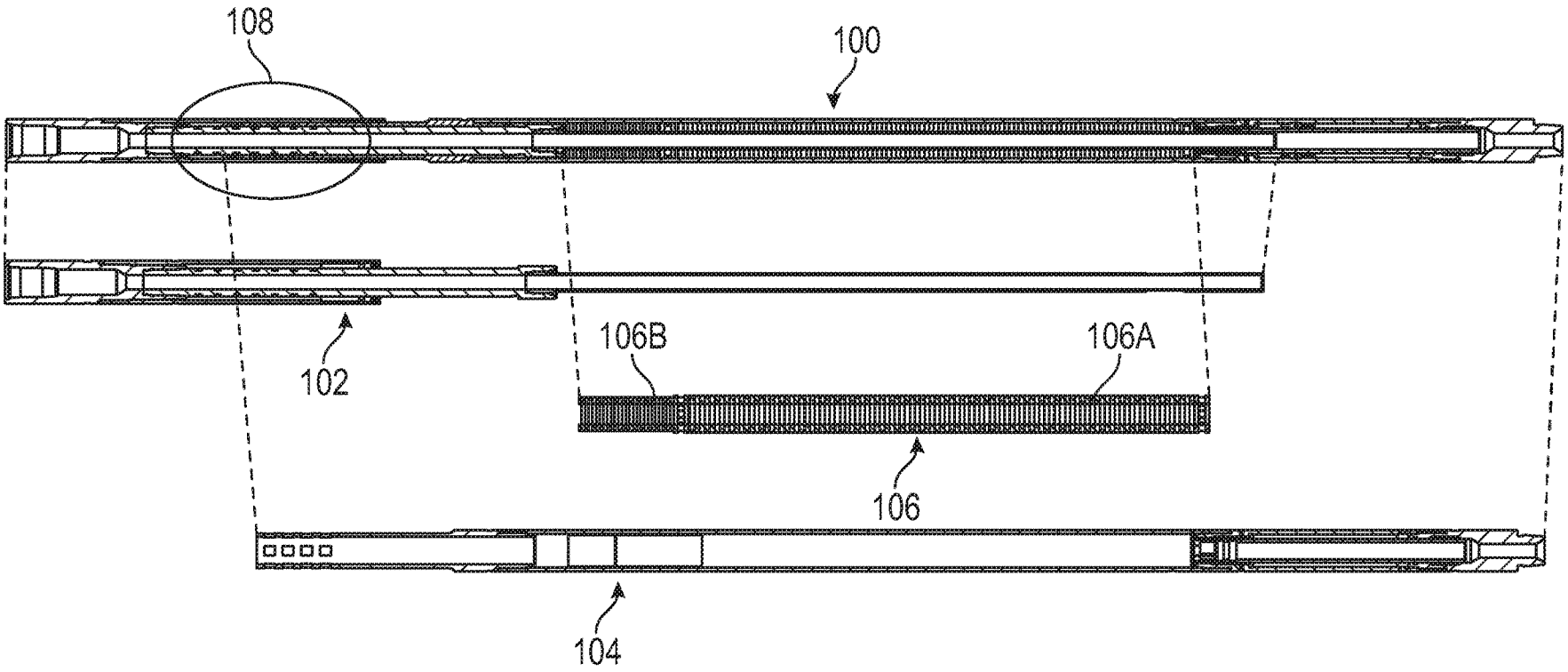
FIG. 3 is a longitudinal cross-sectional view and an exploded view thereof.

The elongate stem or spring tube 114 may extend distally from the lead screw 112 and may be configured to provide a central and longitudinally extending guide for the biasing mechanism 106. The spring tube 114 may also control the amount of longitudinal motion of the distal end of the biasing mechanism 106. The spring tube 114 may have a pin end that engages the distal box end 126 of the lead screw 112 and may include a generally tubular and elongate element having an outer cylindrical surface and an elongate bore extending therethrough. As shown in FIG. 3, the spring tube 114 may extend through the biasing mechanism 106 and slightly beyond the biasing mechanism 106 and into the pressure equalizing assembly 148 of the sleeve 104. Near the distal end of the spring tube 114, as shown in FIG. 4C, a recess 132 may be provided in an outer surface of the tube 114 to provide a range along the stem for stop ring 190 on the distal end of the spring to travel. The recess 132 may form a distal shoulder 134 to arrest motion of the stop ring 190 in a neutral or tension condition and a proximal shoulder 136.

The enclosure 116 on the mandrel portion 102 may be secured to the proximal box end 110 and may extend distally away from the proximal box end 110 to enclose the helical groove 124 on the lead screw 112. The enclosure 116 may be configured to enclose the helical engagement (e.g., the helical groove 124 and the engaging isolated spline segments discussed below) and maintain oil, grease, or other lubrication in and along the helical engagement and keep dirt, debris, or other external items out of the helical engagement. As shown, the enclosure 116 may threadably engage the outer recess on the distal end of the proximal box end 110 and may extend distally therefrom. The enclosure 116 may be a substantially tubular element having a cylindrical outer surface and a relatively larger inner bore. The inner bore may have a diameter selected to be larger than the outer diameter of the lead screw 112 to create an annular passage 140 to receive a spline body 144 of the sleeve portion 104. At or near the distal end of the enclosure 116, one or more grooves 138 may be provided to receive a sealing element for purposes of maintaining lubrication in the annular passage 140. In addition, a recess 142 in the inner bore of the enclosure 116 may be provided at or near the distal end to receive a bearing sleeve 171 (see FIG. 4A). The bearing sleeve 171 may be a generally cylindrical sleeve configured to engage an outer surface of the sleeve portion 104 and to, thus, inhibit relative lateral motion of the sleeve portion 104 within the enclosure 116 as well as provide bending support, thereby protecting the sealing element at this location. The annular passage 140 may define a proximal or upper most portion of a single oil chamber that extends along and through substantially the full length of the tool 100 excluding, for example, the proximal box end 110 and the distal pin end 150. As such, the annular passage 140 may contain oil for lubricating the helical grooves providing for smooth propagation of the spline segments of the spline blocks along the grooves 124. The single oil chamber and its various connecting pathways between several portions is discussed in more detail below.

Figure 4B:
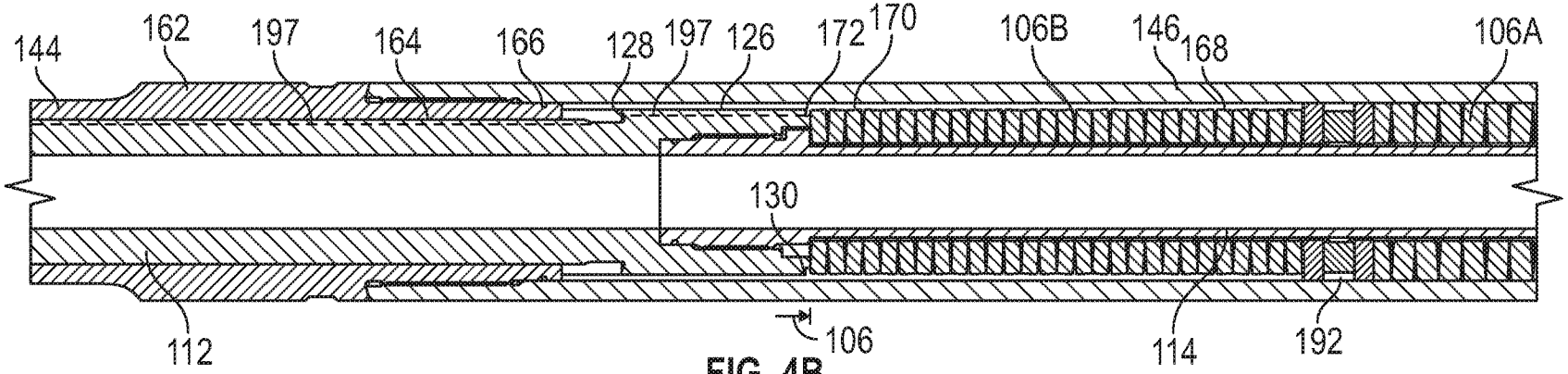
FIG. 4B is a close-up cross-sectional view of a central portion of the vibration mitigation tool of FIGS. 1-3.
Figure 4C:
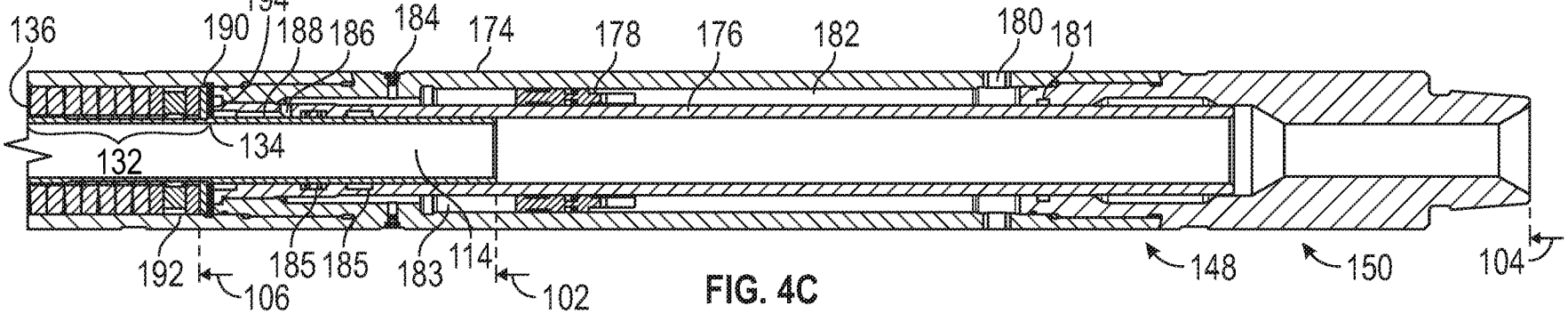
FIG. 4C is a close-up of cross-sectional view of the distal end of the vibration mitigation tool of FIGS. 1-3.

Turning now to the sleeve portion 104 of the tool 100, continued reference is made to FIGS. 4A-4C. The sleeve portion 104 may be configured to engage the lead screw 112 of the mandrel portion 102 as well as contain or enclose the biasing mechanism 106 and associated lubrication. In particular, the sleeve portion 104 may be configured to maintain the pressure in the single lubrication chamber at a pressure that is equalized with wellbore pressure. Still further, the sleeve portion 104 may be configured to provide a distal end connection between the tool 100 and the bottom hole assembly 54 or other portion of the drill string 52. As shown, the sleeve portion 104 may include a spline body 144, a central elongate housing 146, a pressure equalizing assembly 148, and a distal pin end 150.

The spline body 144 is shown starting in FIG. 4A and extending into FIG. 4B. The spline body 144 may be configured to engage the lead screw 112 of the mandrel 102 such that relative longitudinal and rotational motion of the mandrel 102 and the sleeve 104 are related. In particular, the spline body 144 and/or components thereof may be configured to engage the helical groove 124 on the lead screw 112 such that relative longitudinal motion causes relative rotational motion and vice versa. As shown, the spline body 144 may be a generally tubular structure with an outer diameter and an inner bore. The inner bore may be particularly sized and adapted to receive the lead screw 112 of the mandrel 102 and the outer diameter may be particularly sized to fit inside the enclosure 116 of the mandrel 102. That is, the spline body 144 may be sized and configured for arrangement in the annular passage 140 between the enclosure 116 and the lead screw 112 of the mandrel 102. For purposes of engaging the helical groove 124 of the lead screw 112, the spline body 144 may include inwardly extending and isolated spline segments that are adapted to engage the groove 124. In one or more examples, the isolated spline segments may, for example, extend inwardly from the inner surface of the inner bore. In other examples, as shown, the spline body 144 may include receiving pockets 152 for receiving spline blocks 154 that are adapted to engage the groove 124. The receiving pockets 152 may be openings that extend through the spline body 144 to hold the spline blocks 154 and keep them from moving longitudinally or peripherally relative to the spline body 144. The radial position of the spline blocks 154 may be maintained by the outer surface of the lead screw 112 on the inside and the enclosure 116 on the outside. The spline blocks 154 may include a square, rectangular, circular, or other shaped anchor portion 156 having a thickness that is the same or similar to the wall thickness of the spline body 144. The anchor portion may be sized and shaped to fit in the receiving pockets 152 of the spline body 144. A spline segment 158 may extend from an inside surface of the anchor portion 156 and may be adapted to engage and ride in the groove 124 on the outside surface of the lead screw 112. In one or more examples, the spline segment 158 may have a generally square or rectangular profile when viewed in cross-section to match the cross-sectional profile of the groove 124. In still other examples, a trapezoidal or inverted trapezoidal profile may be provided or rounded, U-shaped, triangular, or V-shaped grooves may be provided. Still other cross-sectional profiles may be provided.

The spline body 144 may extend distally providing a cylindrical sealing surface for engagement by seals between the spline body 144 and the enclosure 116. The spline body 144 may extend beyond the enclosure 116 to an enlarged portion 162 that then gives way to a pin end 164 for securing to the central elongate housing 146. The pin end 164 may include threads for securing the central elongate housing 146 to the spline body 144. In addition, a groove 166 may be provided on the outside surface of the pin end 164 to receive a sealing element for sealing the chamber of the biasing mechanism arranged within the central elongate housing 146. In other examples, the groove for the sealing element may be on the inner surface of the central elongate housing 146 or grooves may be provided on both parts.

Figures 6A, 6B, 6C:
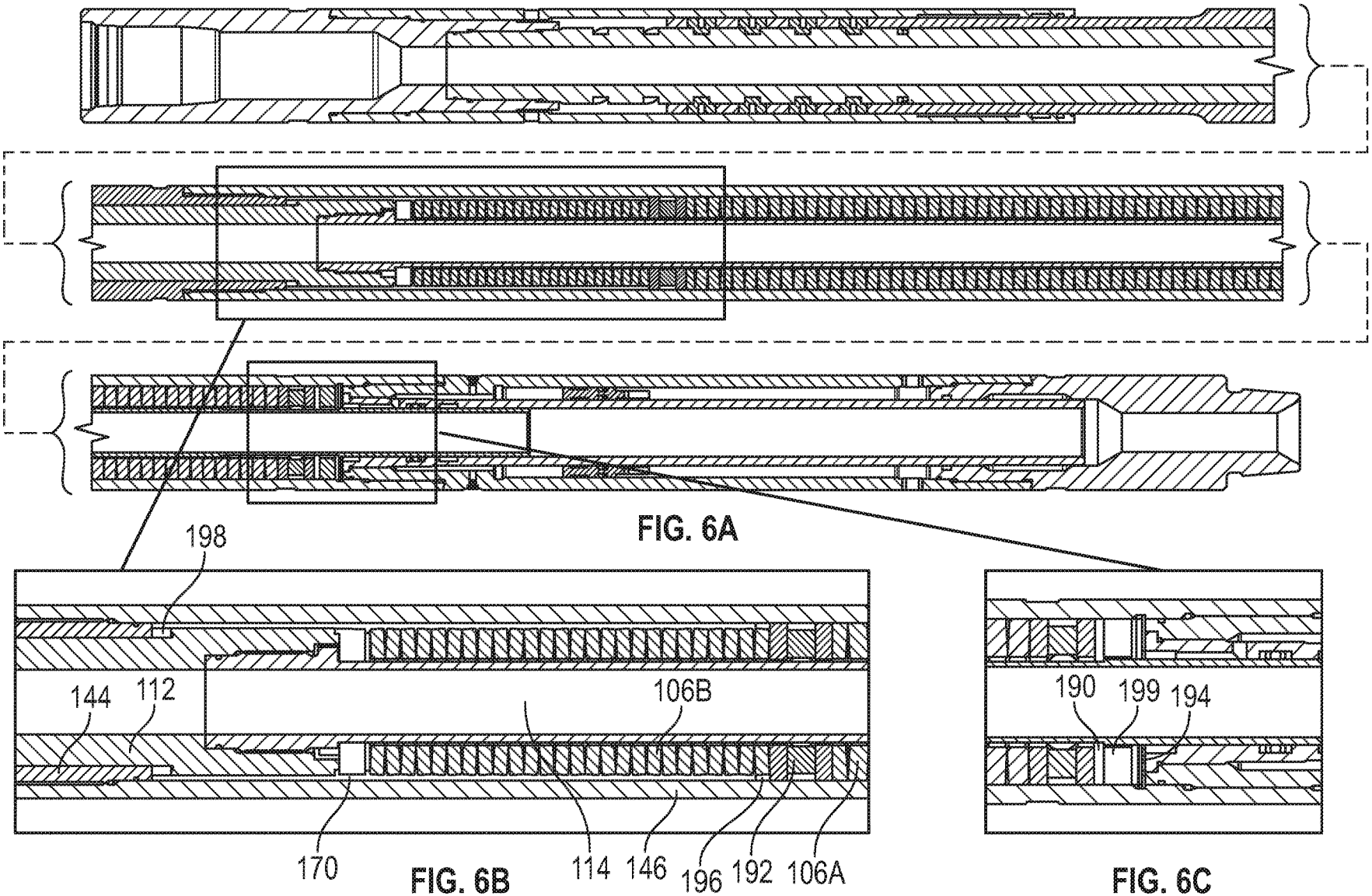
FIG. 6A is a diagram showing the vibration mitigation tool in a tension position, according to one or more examples.
FIG. 6B is a close-up of the first spring and its end conditions in the tension position, according to one or more examples.
FIG. 6C is a close-up of the distal end of the second spring in the tension position, according to one or more examples.
Figures 7A, 7B, 7C:
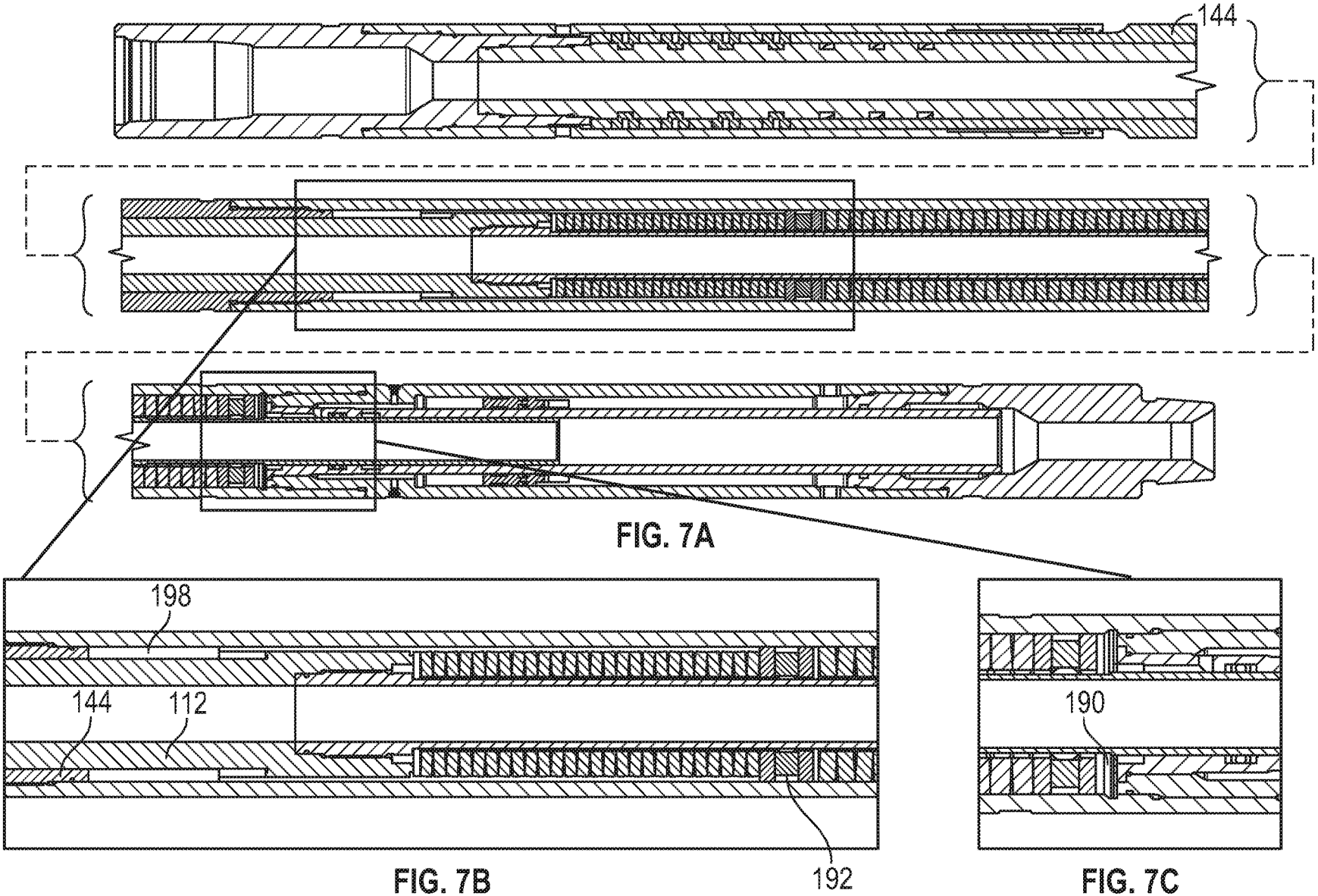
FIG. 7A is a diagram showing the vibration mitigation tool in a compression position, according to one or more examples.
FIG. 7B is a close-up of the first spring and its end conditions in the compression position, according to one or more examples.
FIG. 7C is a close-up of the distal end of the second spring in the compression position, according to one or more examples.

As shown in FIGS. 4B and 4C, the central elongate housing 146 may extend over a large length of the tool 100 and may form a central portion 168 of the single lubrication chamber of the tool and in which the biasing mechanism 106 may be arranged. The central elongate housing 146 may provide external lateral support to the biasing mechanism 106 and may provide containment of lubrication within and along the biasing mechanism 106. The central elongate housing 146 may be a generally tubular element with an outer cylindrical surface and an inner bore sized to receive the biasing mechanism 106. At a proximal end of the central elongate housing 146, an internal bearing sleeve 170 may be provided. The bearing sleeve 170 may be a relatively thin sleeve arranged on an internal surface of the central elongate housing 146. The bearing sleeve 170 may be configured to slide longitudinally within the housing 146 depending on the forces on the tool 100, which will be described in more detail below. The bearing sleeve 170 may include an annular rib 172 arranged along its length and extending around the inner surface of the bearing. The rib 172 may be adapted to engage the proximal end of the biasing mechanism 106 and may be particularly adapted to compress the biasing mechanism 106 when the tool 100 is experiencing tension, as shown in FIGS. 6A-6C. Moreover, when the tool 100 is experiencing compression, as shown in FIG. 7A-7C, the rib 172 may engage the notch 130 on the distal end of the box end 126 of the lead screw 112. The central elongate housing 146 may extend distally to a distal internally threaded end adapted for threadably engaging the pressure equalizing assembly 148. The central elongate housing 146 may house the biasing mechanism 106 and may define an outer boundary of a central portion 168 of the single lubrication chamber extending throughout the tool and, as such, may maintain oil or other lubrication around the biasing mechanism 106 and/or the other components therein.

With reference to FIG. 4C, the pressure equalizing assembly 148 may extend distally from the central elongate housing 146 and may be configured to control pressures in the central portion 168 of the single lubrication chamber of the tool 100. That is, the pressure equalizing assembly 148 may expose the central portion 168 of the lubrication chamber to the pressures within the wellbore without exposing the central portion 168 to the fluids, drill cuttings, or other debris that may be present in and/or around the drill string or bottom hole assembly. As shown, the pressure equalizing assembly 148 may include a housing 174, a wash pipe 176, and a floating divider element 178 (see FIG. 4C).

The housing 174 may include a proximal threaded end for threadably securing the equalizing assembly 148 to the elongate housing 146 and a distal threaded end for threadably securing the housing to the distal pin end 150 of the tool 100. The housing 174 may be a generally tubular element with an outer cylindrical surface and a bore extending therethrough. The outer diameter may be the same or similar to the outer diameter of the elongate housing 146 and the diameter of the inner bore may also be the same or similar to the inner diameter of the elongate housing 146. The housing 174 may include relatively large ports 180, such as bores, extending radially through the housing 174 and into an equalizing chamber 182 within the pressure equalizing assembly 148. The radially extending ports 180 may be arranged at or near the distal end of the housing 174. Smaller, plugged ports 184 may be arranged at the proximal end of the housing 174 for supplying a distal or lower portion 183 of the single lubrication chamber with oil or other lubrication after which the ports 184 may be plugged.

The wash pipe 176 may be configured to establish a radially inward boundary of the equalizing chamber 182 and the lower portion 183 of the single lubrication chamber. The wash pipe 176 may also be configured to provide drill fluid communication from the distal end of the mandrel 102 to the distal pin end 150 of the tool 100. The wash pipe 176 may be a generally cylindrical element with a cylindrical surface and a bore extending therethrough. The proximal end of the wash pipe 176 pipe may threadably engage an inside threaded surface of the distal end of the housing 174 and the distal end may sealingly engage the distal pin end 150. The wash pipe 176 may include one or more grooves 185 on an inside surface near the proximal end for receiving seals and for sealingly engaging the distal end of the mandrel 102. Proximal of the seal grooves 185, the pipe may include one or more passageways 186 that pass radially into the pipe wall from the outside surface and include a groove 188 extending longitudinally along the inside of the pipe wall to the proximal end. These passageways 186 and grooves establish fluid and pressure communication between the lower portion 183 of the single lubrication chamber and the stop ring 190 at the distal end of the biasing mechanism 106. Orifices or other openings may be provided in the stop ring 190 to allow fluid through the stop ring 190 and into the central portion 168 of the single lubrication chamber.

The floating divider element 178, shown in FIG. 4C, may be arranged in an annular space between the housing 174 and the wash pipe 176 and defining a moving or floating boundary between the equalizing chamber 182 and the lower portion 183 of the single lubrication chamber of the tool 100. As shown, the chamber 182 may be on the side of the divider 178 that includes the relatively large ports 180 extending through the housing 174. The lower portion 183 of the single lubrication chamber may be on the other side of the divider 178. The divider 178 comprises an annular element that floats in the annular space between the housing and the wash pipe, maintains a seal between the chamber 182 and the lower portion 183 of the lubrication chamber, but provides a pressure communication therebetween. The divider element 178 may include grooves for receiving seals such as rod seals, lip seals, o-ring seals or other sealing element(s) on an outside and inside surface thereof to sealingly engage the inside surface of the housing 174 and the outside surface of the wash pipe 176.

The pin end 150 of the tool 100 may extend distally from the pressure equalizing assembly 148 and may be configured for securing the tool 100 to downstream or down string tubulars, tools, or equipment. The proximal end of the pin end 150 may include external threads for threadingly securing the pin end 150 to the housing 174 of the equalizing assembly 148. A groove may be provided on an inside or bore side surface of the proximal end of the pin end to receive a seal 181 and seal against the wash pipe 176 of the equalizing assembly 148. The distal end of the pin end 150 may be a tapered conical element with a threaded outer surface that is similar to pin ends of tubulars such as drill pipes and/or drill collar, for example.

With reference back to FIG. 3, the biasing mechanism 106 may extend, generally, from a distal end of the lead screw 112 to distal end of the elongate housing component 146. The biasing mechanism 106 may be generally annularly shaped and may sleeve over the spring tube 114 of the mandrel 102 and pass within the elongate housing 146. The biasing mechanism 106 may be configured to absorb both tension and compression energy applied to the tool 100. In one or more examples, the biasing mechanism 100 may be a coiled spring, disc spring or stack, friction spring, composite, rubber, or other elastomeric material spring, or another type of biasing mechanism 106. As shown, the biasing mechanism 106 may be in the form of a spring stack having a series of disc spring washers. The washers may be frusto-conical and may alternate with respect to the direction of their concavity. Still other types of springs may be provided. In the present example, a primary spring 106A and a secondary spring 106B may be provided where the primary spring 106A is longer and has a higher spring constant than the secondary spring 106B or, in other words, is a stronger or stiffer spring. As shown, the primary spring 106A may extend over approximately 50-95%, or 75-90%, or approximately 85% of the overall length of the spring stack. The secondary spring 106B may make up the remaining length of the spring stack aside from bearings, end elements, and other aspects of the biasing mechanism. Moreover, the secondary spring 106B may be arranged proximal to the primary spring 106A.

As shown in FIG. 4B, the proximal end of the spring stack may bear against the rib 172 on the inside surface of the bearing sleeve 170 within the elongate housing element 146. As shown in FIG. 4C, the distal end of the spring stack may bear against a thrust bearing 192, which may, in turn bear on an annular bearing plate or stop ring 190 that engages the distal shoulder 134 on an outside surface of the spring tube 114 of the mandrel 102. A thrust bearing 192 may also be provided at a location between the primary and the secondary spring 106A/B as shown in FIG. 4B. The thrust bearings 192 may include a pair of annular plates separated by radially oriented roller pins. Also, for retaining purposes a retainer ring 194 may be provided distal to the annular bearing plate or stop ring plate 190.

As mentioned, the tool 100 may have a single lubrication chamber made up of an upper portion 140, a central portion 168 and a lower portion 183. The single lubrication chamber may be filled via the fill ports 184. Filling the chamber may cause the lubrication to enter the lower portion 183, pass into the central portion 168, and then into the upper portion 140. Regarding flow of the lubrication between the lower portion 183 and the central portion 168, reference is made to FIG. 4C. As fluid flows into lower portion 183 of the lubrication chamber, it may make its way upward along the wash pipe 176 to passageways 186 extending radially into the outside surface of the wash pipe and then along vertically or longitudinally extending grooves 188 on an inside surface of the wash pipe 176. The lubrication may flow through the stop ring 190 by way of openings, holes, or other orifices in the stop ring. Still further, the retainer 194 may have an inner annular diameter larger than the spring tube, and as such may avoid inhibiting the flow of the lubrication. Once the lubrication reaches the central portion 168 of the lubrication chamber, it may fill the central portion and make its way to the upper chamber. With reference to FIG. 4B, the lubrication may flow from the central chamber and into longitudinally extending slots 197 on an outside surface of the box end 126 of the lead screw 112 and on outside surface of the lead screw 112 itself so as to reach the upper portion or annular space 140. A vent/filling port (not shown) may also be provided at or near a top or distal portion of the annular space 140. Accordingly, a single lubrication chamber may be provided on the tool. It is to be appreciated, that while a single lubrication chamber has been provided, the three portions thereof may, alternatively, be isolated chambers with separate filling and venting ports, for example.

In operation and use, the tool 100 may provide for absorption of shock or vibration and, in particular, may provide for absorption of torsional shock or vibration in addition to longitudinal shock or vibration and/or lateral shock or vibration. The tool 100 may have a neutral condition and during absorption of shock may move to a compression position or a tension position.

Figures 5A, 5B, 5C:
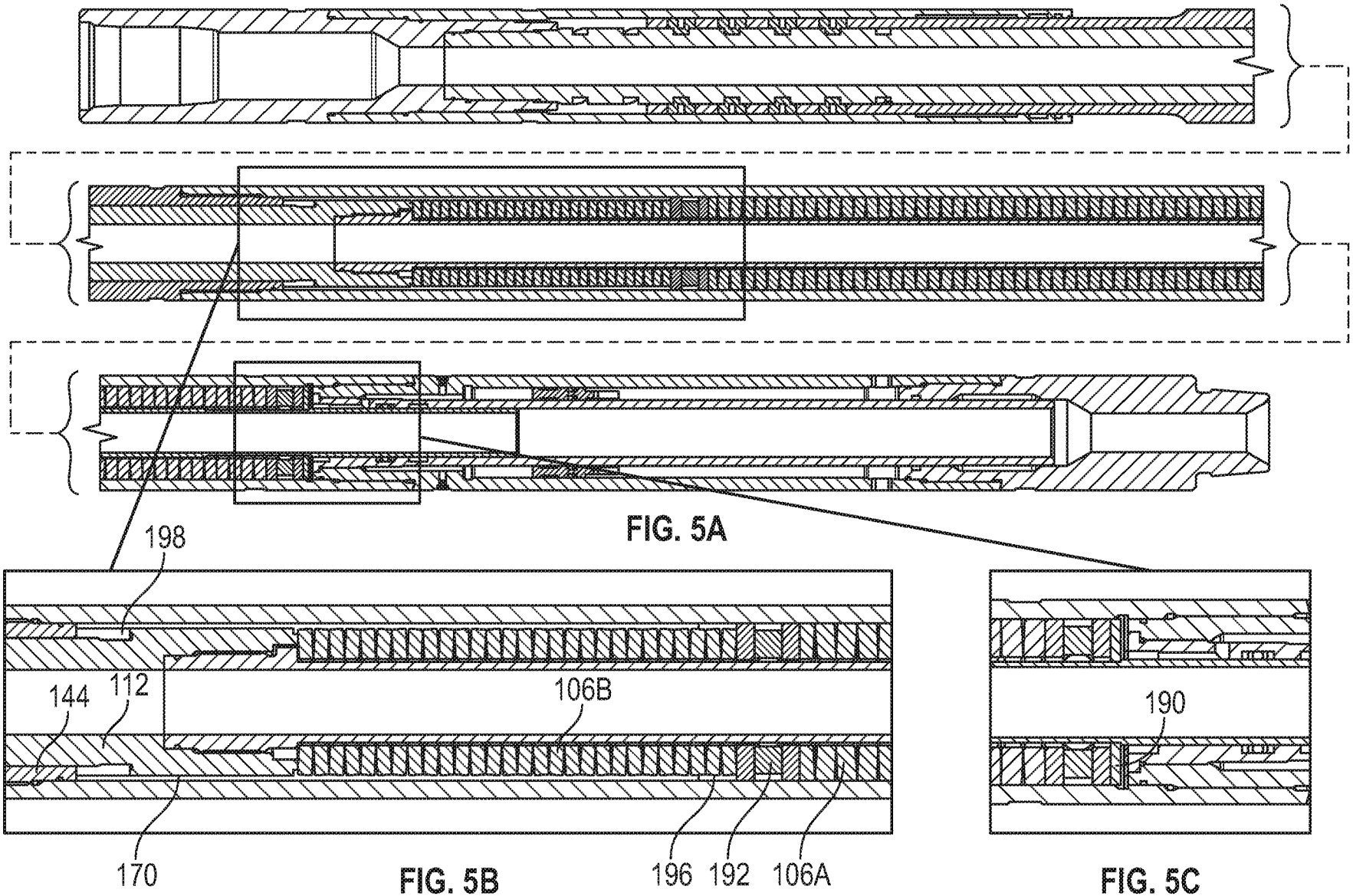
FIG. 5A is a diagram showing the vibration mitigation tool in a neutral position, according to one or more examples.
FIG. 5B is a close-up of the first spring and its end conditions in the neutral position, according to one or more examples.
FIG. 5C is a close-up of the distal end of the second spring in the neutral position, according to one or more examples.

A neutral position is shown in FIGS. 5A-5C. As shown, in the neutral position, the proximal end of the spring stack may bear against the rib 172 on the bearing sleeve 170 and on the distal end of the lead screw 112 of the mandrel 102. It is noted that the proximal end of the bearing sleeve 170 is in contact with the distal end of the spline body 144 and a gap 196 is present between the distal end of the bearing sleeve 170 and the thrust bearing 192 between the primary and secondary springs 106A/B. A gap 198 is also present between the distal end of the spline body 144 and the shoulder 128 on the box end 126 of the lead screw 112. The distal end of the of the spring stack may bear against the stop ring 190, which bears on the shoulder 134 on an outside surface of the spring tube 114 of the mandrel 102.

A tension position of the tool 100 is shown in FIGS. 6A-6C. In this condition, forces are pulling the sleeve portion 104 and the mandrel portion 102 away from each other. As shown in FIG. 6B, the bearing sleeve 170 within the elongate housing 146 is forced in a distal direction relative to the mandrel portion 102 by the distal end of the spline body 144. The rib 172 on the bearing sleeve 170, in turn, forces the proximal end of the spring in a distal direction as well, compressing the secondary spring 106B between the rib 172 and the thrust bearing 192 between the primary and secondary springs 106A/B. It is noted that the gap 196 between the distal end of the bearing sleeve 170 and the thrust bearing 192 between the primary and secondary springs has been reduced and the gap 198 between the distal end of the spline body 144 and the shoulder 128 on the lead screw 112 has also been reduced. At the distal end of the spring stack, the primary spring 106A continues to bear on the stop ring 190, which bears on the shoulder 134 on the outside surface of the spring tube 114 of the mandrel 102, but a gap 199 has developed between the retainer ring 194 and the stop ring 190 because the distal motion of the stop ring is arrested on the shoulder 134 of the spring tube. The secondary spring is compressed between the thrust bearing separating the primary/secondary springs and the distal thrust bearing, which distal motion of the distal thrust bearing is arrested by stop ring arrested by the shoulder 134.

A compression position of the tool 100 is shown in FIGS. 7A-7C. In this condition, forces are pushing the sleeve portion 104 and the mandrel portion 102 together. As shown in FIG. 7A, the spline body 144 has propagated proximally relative to the mandrel 102 and is engaged in the proximal most portions of the helical grooves 124. As shown in FIG. 7B, the bearing sleeve 170 has moved proximally relative to the distal end of the lead screw 112 such that the rib 172 on the bearing sleeve 170 engages the notch 130 on the end thereof. Moreover, the gap 196 between the distal end of the bearing sleeve 170 and the thrust bearing 192 between the primary and secondary springs 106A/B has also gone away. This may function to protect the secondary spring 106B from over compression. That is, at some level of compression of the secondary spring 106B when the tool is under compression, the bearing sleeve will limit the amount of compression in the secondary spring 106B. To be clear, the secondary spring may remain in compression between the thrust bearing 192 separating the two springs and the rib on the sleeve, but the degree of compression may be limited. Moreover, compression in the primary spring 106A has allowed the gap 198 between the distal end of the spline body 144 and the shoulder 128 on the box end of the lead screw 112 to increase a relatively large amount. As shown in FIG. 7C, the pin end and the pressure equalizing assembly 148 have pushed upward on the distal end of the spring stack causing the stop ring 190 to slide along the spring tube 114 of the mandrel 102 and approach upper shoulder 136 along the length of the spring tube 114. The primary spring 106A is thus compressed between the distal thrust bearing, which is being forced proximally by the stop ring 190, and the thrust bearing separating the primary/secondary springs 106A/B. In the tension condition and the compression condition, when the spline body 144 moves longitudinally relative to the lead screw 112, the sleeve portion 104 and the mandrel portion 102 rotate relative to one another due to the spline blocks 154 traveling along the helical groove 124 on the surface of the lead screw 112.

It is to be appreciated from the description above that whether the tool 100 is in tension or compression, the primary spring 106A and the secondary spring 106B are compressed toward one another in both instances and, notably, are not compressed in a direction away from one another in either instance. This may be a relevant distinction between the present tool and some of the prior art tools available on the market.

It is also to be appreciated that while the helical groove 124 has been described as being present on the lead screw 112 and the spline blocks 154 have been described as being part of the spline body 144, an opposite approach could be used or grooves and spline segments or protrusions may be provided on both, for example. Still further, while seal grooves have been described as being on one side of a sealing interface, grooves may be provided on the opposite side of the interface or grooves on both sides may be provided.

As mentioned with respect to FIGS. 7A-7C, when the tool is being compressed, the bearing sleeve 170 may move proximally relative to the distal end of the lead screw 112 such that the rib 172 on the bearing sleeve 170 engages the notch 130 on the end thereof and the distal end of the bearing sleeve 170 may engage the thrust bearing 192 between the primary and secondary springs 106A/B. As mentioned, this may function to protect the secondary spring from over compression. Accordingly, the length of the bearing sleeve and/or the location of the rib may be selected based on the amount of compression that may be desired (or not desired) of the secondary spring 106B. That is, depending on the material, the strength, and/or the spring constant of the secondary spring 106B, the length of the bearing sleeve 170 and/or the location of the rib 172 may be selected to control the degree of compression of the secondary spring. In one or more examples, a suitable degree of compression may range from 5% to 75%, or from 15% to 50%, or from 25% to 35%, or another selected percentage that avoids fully flattening out or otherwise yielding the spring.

The presently described tool 100 may be advantageous for a variety of reasons. In particular, the tool 100 may reduce stick-slip by mitigating axial, lateral, and/or torsional vibration and may absorb, for example, torque spikes caused by sudden reduction in drill bit rpm. More particularly, the spring stack may provide dual functions by absorbing both tension and compression forces as well as torque. That is, while a primary spring 106A and a secondary spring 106B are provided, the stack, as a whole, functions to absorb both tension and compression forces. The lubrication is advantageous in several ways by providing a single oil reservoir for lubricating both the helical engagement section and the spring stack portion. That is, the several portions of the single lubrication chamber including the upper portion or annular space 140, the central portion 168, and the lower portion 183 may all be in fluid communication with one another to form a single lubrication chamber, which can make it very straight forward to perform maintenance on the tool such as by changing the lubrication fluid. Still further, the entire oil chamber including the upper portion 140, the central portion 168, and the lower portion 183 may be hydrostatically balanced with the wellbore pressures due to the pressure equalizing assembly 148, which provides an equalization chamber 182 and floating divider 178 separating the equalization chamber from the lower portion 183. The helical grooves 124 in the lead screw 112 are also advantageous as having a strong square or rectangular cross-section for an efficient transfer of torque and less frictional resistance. Still another advantage is the increased control of the depth of cut/engagement of the drill bit using the present tool. That is, the tool may allow for the drill bit to softly land on the hole bottom and improve cutting engagement. Still other advantages will be appreciated by those of skill in the art.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A vibration mitigation tool, comprising:

a mandrel portion; and a sleeve portion arranged about the mandrel portion and configured to move longitudinally and rotationally relative to the mandrel portion;

wherein, the mandrel portion and the sleeve portion together form a lubrication chamber including a first portion configured for lubricating a helical engagement, a second portion in fluid communication with the first portion and for lubricating a biasing mechanism, and a third portion in fluid communication within the vibration mitigation tool with the first portion and the second portion and for interfacing with a pressure equalizing chamber.

2. The vibration mitigation tool of claim 1, wherein the lubrication chamber is hydrostatically balanced with environmental pressures around the vibration mitigation tool via the pressure equalizing chamber.

3. The vibration mitigation tool of claim 2, further comprising a pressure equalizing assembly configured for hydrostatically balancing the lubrication chamber.

4. The vibration mitigation tool of claim 3, wherein the pressure equalizing assembly comprises an outer housing and a wash pipe defining the pressure equalizing chamber and the outer housing comprises radial bores placing the pressure equalizing chamber in fluid communication with an area outside the vibration mitigation tool.

5. The vibration mitigation tool of claim 4, wherein the pressure equalizing assembly comprises a floating divider arranged between the pressure equalizing chamber and the third portion of the lubrication chamber.

6. The vibration mitigation tool of claim 1, wherein the first portion, the second portion, and the third portion of the lubrication chamber are in fluid communication with one another.

7. The vibration mitigation tool of claim 6, wherein the fluid communication between the third portion and the second portion of the lubrication chamber is by way of a radial passage and a longitudinally extending groove in a proximal portion of a wash pipe.

* * * * *